US005159842A

United States Patent [19]

Palmer et al.

[11] Patent Number: 5,159,842

[45] Date of Patent: Nov. 3, 1992

[54] SELF-CLEANING PIPETTE TIPS

[75] Inventors: Harvey J. Palmer, Lima; Richard L. Columbus, Rochester, both of N.Y.

[73] Assignee: Eastman Kodak Company, Rochester, N.Y.

[21] Appl. No.: 717,551

[22] Filed: Jun. 19, 1991

[51] Int. Cl.[5] ..... B01L 3/02

[52] U.S. Cl. ..... 73/864.01; 73/864.14

[58] Field of Search ..... 73/864.01, 864.14; 422/100

[56] References Cited

U.S. PATENT DOCUMENTS

| | | | |
|---|---|---|---|
| Re. 27,637 | 5/1973 | Roach | 73/864.14 |
| 2,946,486 | 7/1960 | Gilmont | 73/864.14 X |
| 3,040,931 | 6/1962 | Sanz | 73/864.14 X |
| 3,175,734 | 3/1965 | Heiss | 73/864.14 X |
| 3,177,723 | 4/1965 | Pedersen | 73/864.14 |
| 3,258,972 | 7/1966 | Cassaday et al. | 73/864.01 |
| 3,500,689 | 3/1970 | Band | 73/864.01 |
| 4,347,875 | 9/1982 | Columbus | 73/864.11 X |
| 4,905,526 | 3/1990 | Magnussen, Jr. et al. | 73/864.18 |

FOREIGN PATENT DOCUMENTS

| | | | |
|---|---|---|---|
| 53655 | 7/1946 | France | 73/864.01 |
| 207154 | 2/1984 | German Democratic Rep. . | |

*Primary Examiner*—Tom Noland

*Attorney, Agent, or Firm*—Dana M. Schmidt

[57] ABSTRACT

There are disclosed pipette tips having a wettable exterior surface shaped to force liquid that wets it to not fall under the influence of gravity to the terminal surface at which the dispensing aperture is located. For this, the radius $R_o$ of that wettable surface at the terminal surface satisfies the equation (I) $R_o < (\sigma/\rho g)^{\frac{1}{2}}$ and the slope of the wettable surface satisfies the equation (II) $dz/dr < (\sigma^2/(\rho g r^2)^2 - 1)^{\frac{1}{2}}$ where dz/dr is the rate of change in the height per the rate of change of distance from the axis of symmetry of the tip.

4 Claims, 2 Drawing Sheets

SELF-CLEANING PIPETTE TIPS

FIELD OF THE INVENTION

This invention relates to pipette tips, and especially to those that are self-cleaning.

Pipette tips used in aspiration and dispensing must both receive and accommodate liquid aspirated into them, and then dispense the liquid without adversely altering the amount dispensed. The chief factor interfering with the latter is the film of liquid left on the exterior of the tip after aspiration. This film, in most pipette tips, falls under the influence of gravity to the pipette aperture, where it collects in a drop or droplets that then coalesce with the amount being dispensed. This added amount, by its unpredictability, interferes with the accuracy of the dispensing.

A solution to this problem has been provided by the pipette of U.S. Pat. No. 4,347,875. This tip features a sharp, angular increase in the radius of the exterior surface, sufficient to draw liquid below that increase, away from the dispensing aperture. Although this shape has been highly effective, it is limited in that: a) it works only when located a certain distance from the tip aperture, and b) it has not been generalized to cover an entire class of surfaces, or for that matter, surfaces having a gradual change in curvature rather than a sharp change.

Therefore, prior to this invention there has been a need to generalize the phenomenon to allow gradual curve shapes to be used.

East German Publication 207154 discloses a pipette tip that might appear to accomplish the goal, albeit inadvertently. However, as will be shown hereinafter, even it is not satisfactory.

SUMMARY OF THE INVENTION

We have devised the formula for the shape of the curve that will ensure that a class of curves can be used all of which will draw the liquid on the exterior surface away from the dispensing aperture, against the influence of gravity.

More specifically, there is provided a self-cleaning pipette tip for aspirating and dispensing liquid without adverse effects due to liquid portions left on the exterior of the tip, said tip comprising a wall shaped to define a confining chamber about an axis of symmetry, means in the wall defining an aperture fluidly connected to the chamber, the means including a terminal surface of the wall having a generally circular shape with a radius $R_o$ centered on the axis, wherein $R_o$ satisfies the equation $$R_o < (\sigma/\rho g)^{178} \text{ and} \quad \text{(I)}$$

$\sigma$ = the surface tension of the liquid, $\rho$ = the mass density of the liquid and g = the gravitational constant of 980 cm/sec$^2$, the exterior shape of the wall as it extends from the terminal surface a distance that at least exceeds $R_o$, being constantly changing such that the rate of change of the curve's distance z along said axis from the terminal surface, with respect to the rate of change of the curve s distance r from the axis, follows the equation $$dz/dr < (\sigma^2/(\rho g^2)^{2-1})^{\frac{1}{2}} \quad \text{(II)}$$

where dz/dr is the derivative of z with respect to r, which is the local slope of the exterior surface.

Accordingly, it is an advantageous feature of the invention that pipette tips are provided with a family of shapes that will ensure that the liquid remaining on the exterior side walls following aspiration does not fall to the orifice to interfere with liquid dispensing.

It is a related advantageous feature of the invention that such shapes are curved, with no sharp break in the curve.

Other advantageous features will become apparent upon reference to the following Description, when read in light of the attached drawings.

DESCRIPTION OF THE PREFERRED EMBODIMENTS

The invention is described hereinafter in connection with certain preferred embodiments in which a disposable pipette tip is used to aspirate and dispense biological liquids into and out of an orifice that is centered on an axis of symmetry of the tip. In addition, it is useful regardless of the liquid that is being handled, and regardless of the location of the aperture relative to the axis—that is, the aperture can be off center as well. Further, the invention is useful whether or not the tip is disposable or permanent.

Figure 1:
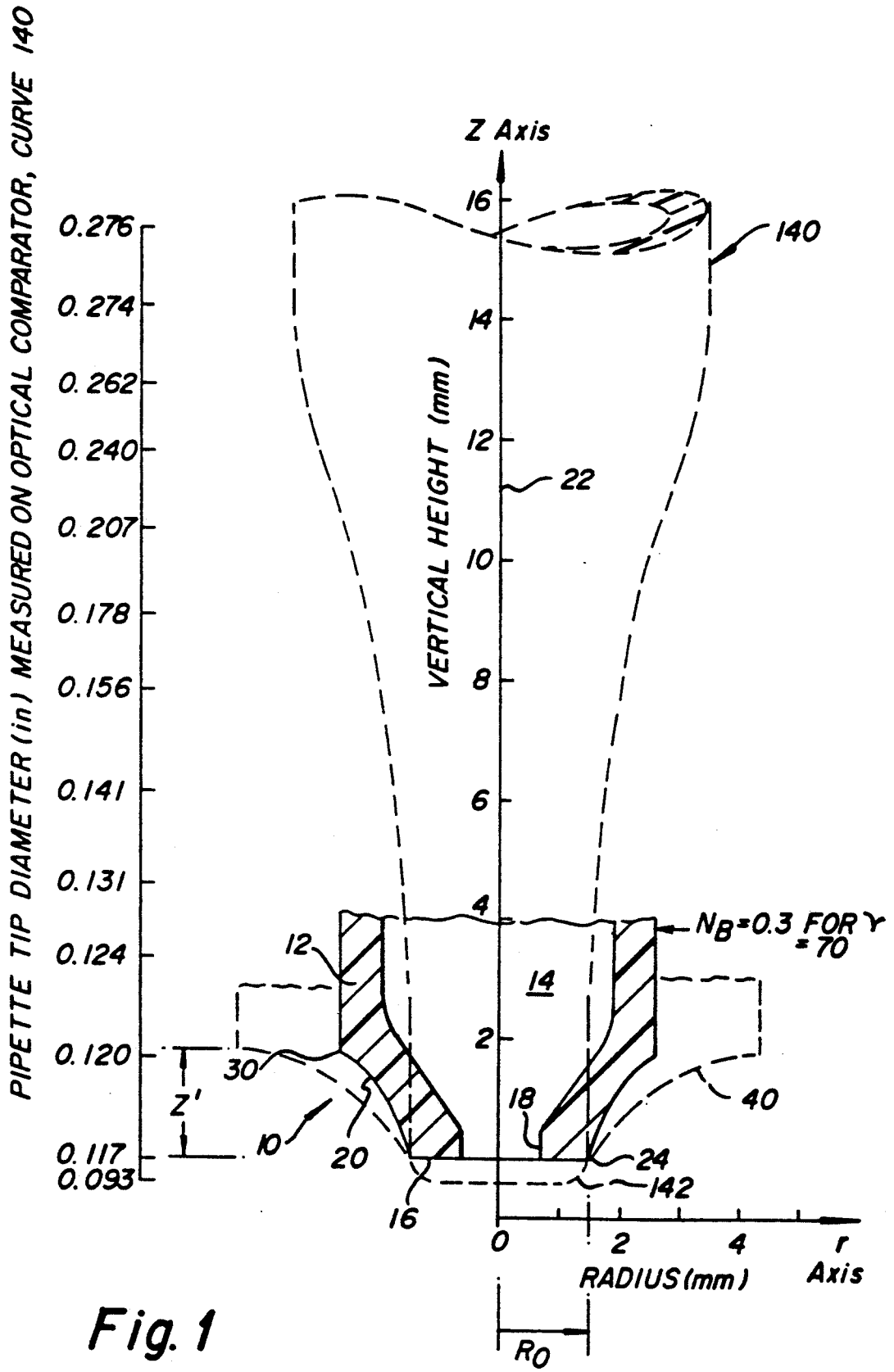
FIG. 1 is a plot of the shape of the exterior wall of both a tip constructed in accordance with the invention, and a prior art tip.

Referring to FIG. 1, all pipette tips, including tip 10 of the invention, are provided with a side wall 12 shaped to provide a confining or storage chamber 14 fluidly connected to a terminal surface 16 extending from wall 12, constructed to provide an aperture 18 that allows access to the chamber. It is the exterior surface 20 of wall 12 that is undesirably wetted when the tip is inserted into a body of liquid for aspiration. Conveniently, wall 12 is shaped so as to wrap around an axis 22 of symmetry, on which aperture 18 can be centered, as shown, or not.

Surface 16 has an outside radius of $R_o$, assuming that edge 24 of surface 16 is circular (the usual configuration). As shown in FIG. 1, that radius is 1.5 mm.

It can be shown from the science of fluid mechanics that surface tension and gravity dictate that, for liquid on surface 20 to remain there and not fall down, in defiance of gravity, the value of $R_o$ and the change in slope of wall surface 40 are critical. This invention resides in the application of those critical values for the first time to the shape of the outside surface of the pipette tips, to ensure that such liquid does in fact defy gravity.

First of all, regarding $R_o$, it can be shown that a necessary, but not sufficient condition, is that equation (0) must be true:

$$N_B = \rho g R_o^2/\sigma \text{ must be} < 1.0 \quad \text{(0)}$$

where $N_B$ = *the Bond number,* $\rho$ = *mass density of the liquid,* g = *gravitational acceleration, and* $\sigma$ = *surface tension of the liquid on the exterior surface* 20. *This in turn means that*

(1) $R_o < (\sigma/\rho g)^{178}$ (1)

, just to set the stage for arriving at possible slopes that will work.

Still further, assuming $R_o$ meets the conditions of equation (1), it can be shown that if the rate of change of surface 20's distance z vertically along axis 22, with respect to the rate of change of surface 20's distance r in the r axis direction from axis 22 follows the equation:

$$dz/dr < (\sigma^2/(\rho g r^2)^2 - 1)^{178} \quad (2)$$

at each and every point along surface 20, up to a distance z' (from surface 16) that at least equals the value of $R_o$, then that surface 20 will draw liquid away from surface 16.

Surface 20 of FIG. 1 is in fact such a surface with a constantly changing curve, extending from surface 16 to edge 30 a z' distance (about 2 mm) that exceeds the $R_o$ value of 1.5 mm. In fact, this is the shape at which liquid will just sit on surface 20, and neither creep up that surface, nor fall down to surface 16, for values of $\sigma = 70$ dynes/cm, or more generally for NB (defined above) = 0.3.

In addition, if surface 20 were shaped as shown in phantom, surface 40, then surface 40 would favor surface tension so much that the liquid on the surface 40 would climb up away from terminal surface 16.

In contrast, however, phantom curve 140 (the additional 100 digit being used to designate comparative examples) is an inoperative shape, since for the very same value of $R_o$, surface 140 falls inside the envelope of surface 20. Such a shape fails because gravity will prevail, due to the large ratio of dz/dr that exceeds the value $(\sigma^2/(\rho g r^2)^2 - 1)^{\frac{1}{2}}$ as also shown by the essentially vertical slope of that surface. Any liquid on that surface will perforce fall to surface 16 where it will interfere with dispensing operations. Coincidentally, curve 140 is the standard shape of any conventional eye dropper that can be purchased in a drugstore. (The rounded edge 142 of the dropper can be ignored, since any exterior liquid that falls to that edge will necessarily interfere with dispensing.)

Figure 2:
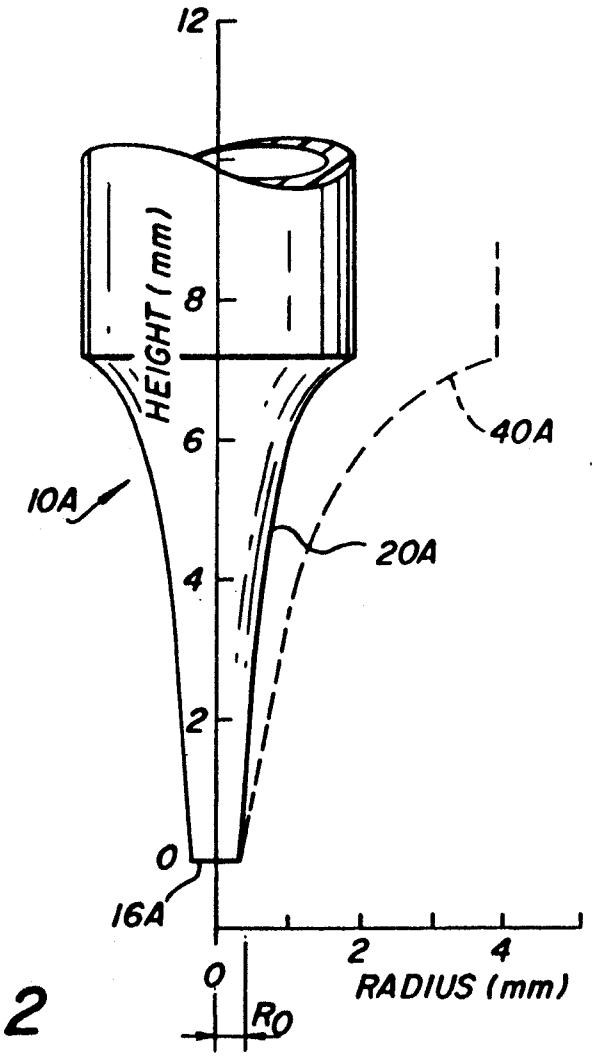
FIG. 2 is a similar plot but of another, and more practical tip constructed in accordance with the invention.

Although the shape of surface 20 will work to achieve the stated goal, it does after all extend upwards only 2 mm, a distance that hardly allows for any error in the insertion of the tip into the liquid. Furthermore, for the preferred liquids, namely biological liquids, $\sigma$ is between 35 and 70 dynes/cm, $\rho$ = about 1.0 g/cc, and $R_o$ varies from between about 0.3 mm to about 2.5 mm. Thus, shape 40 will work for only a limited set of these liquids, namely liquids whose surface tension is $\sigma > \approx 55$ dynes/cm. For $R_o = 1.5$ mm, a more preferred height for surface 20 along the y axis is one that is at least 4X the value of $R_o$, or in this case, a distance of about 6 mm. To achieve such a height, in practice it is necessary to reduce the value of $R_o$. FIG. 2 illustrates such a construction for tip 10. Parts similar to those previously described bear the same reference numeral to which the distinguishing suffix "A" is appended. Surface 16A of tip 10A has a radius $R_o = 0.38$ mm, and for $\sigma \geqq 35$ dynes/cm, NB is $\leqq 0.04$. The height of exterior surface 20A is over 7 mm, and provides a dz/dr exactly equal to the square root value of equation (2), for $\sigma = 35$ dynes/cm. Thus, any liquid on the surface 20A of this surface tension value will stay put, neither rising up, nor falling down towards surface 16A. Additionally, liquids on surface 20A with surface tension values greater than 35 dynes/cm will rise up away from surface 16A. Tips having a blunter shape, such as curve 40A, shown in phantom, will cause the liquid to rise away from surface 16A even for surface tensions equal to 35 dynes/cm, since that surface falls "outside" surface 20A for the same value of $R_o$.

Figure 3:
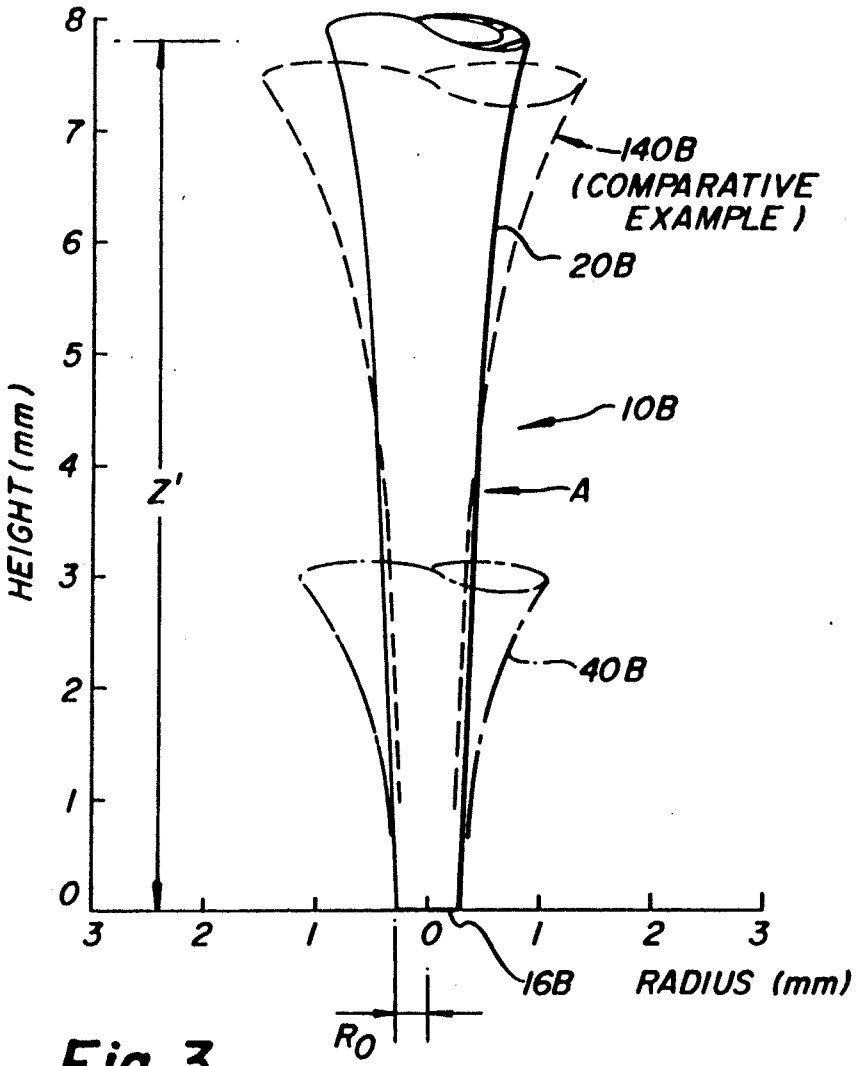
FIG. 3 is a plot similar to that of FIG. 1 illustrating yet some additional tip shapes constructed in accord with the invention, contrasted to a tip described in the aforesaid German publication.

FIG. 3 illustrates still other examples for $R_o = 0.3$ mm, and a comparative example. Parts similar to those previously described bear the same reference numeral to which the distinguishing suffix "B" is appended. Thus, tip 10B has an $R_o$ for surface 16B that = 0.3 mm. Surface 20B extends for a height z' that exceeds 7 mm, and is again the shape that exactly equals the square root value of equation (2) for $\sigma = 35$ dynes/cm. (This is the minimum value, generally, for biological fluids or liquids such as blood serum.) Thus, this shape ensures that such a liquid will remain in place on surface 20B, neither rising nor falling. If, as is likely, $\sigma > 35$ dynes/cm, then for this shape the liquid will move away (rise) from surface 16B. Alternatively, if $\sigma = 35$ dynes/cm but the shape is that of surface 40B, the liquid also will rise away from surface 16B.

As a comparative example, surface 140B is the shape of the preferred example (Ex. 1) given in the aforesaid East German publication, where $R_o = 0.25$ mm ("I.D. = 0.3 mm" means that the internal radius = 0.15 mm, and a wall thickness of 0.1 mm gives $R_o = 0.25$ mm.)

Interestingly, surface 140B will provide the instant invention, but only from point A upwards. Any liquid deposited on the bottom 3.5 mm of surface 140B will fall to surface 15B. Since it is the bottom 4 mm that are usually wetted during aspiration, this shape overall must FAIL.

The invention has been described in detail with particular reference to preferred embodiments thereof, but it will be understood that variations and modifications can be effected within the spirit and scope of the invention.

What is claimed is:

1. A self-cleaning pipette tip for aspirating and dispensing liquid of a surface tension from about 35 to 70 dynes/cm, without adverse effects due to liquid portions left on the exterior of the tip, said tip comprising a wall shaped to define a confining chamber about an axis of symmetry, means in said wall defining an aperture fluidly connected to said chamber, said means including a terminal surface of said wall having a generally circular shape with a radius $R_o$ centered on said axis, wherein $R_o$ satisfies the equation $$R_o < (\sigma/\rho g)^{178} \text{ and} \quad (I)$$

$\sigma$ = the surface tension of the liquid, $\rho$ = the mass density of the liquid and g = the gravitational constant of 980 cm/sec$^2$, the exterior shape of said wall as it extends from said terminal surface a distance that at least exceeds $R_o$, being constantly changing such that the rate of change of the curve's distance z from said terminal surface with respect to the rate of change of the curve's distance r from said axis, follows the equation $$dz/dr < (\sigma^2/(\rho g r^2)^2 - 1)^{178} \quad (II)$$

where dz/dr is the derivative of z with respect to r, which is the local slope of the exterior surface.

2. A tip as defined in claim 1, wherein the liquid has a surface tension varying from about 35 to 70 dynes/cm, $\rho =$ about 1.0 g/cc, and $R_o$ varies from between about 0.3 mm to about 2.5 mm.

3. A tip as defined in claim 2, wherein said exterior shape extends with a shape defined by equation (II) for a distance that is at least 4 times the value of said radius $R_o$.

4. A tip as defined in claim 1, wherein said exterior shape extends with a shape defined by equation (II) for a distance that is at least 4 times the value of said radius $R_o$.

* * * * *

UNITED STATES PATENT AND TRADEMARK OFFICE

CERTIFICATE OF CORRECTION

PATENT NO. : 5,159,842

DATED : November 3, 1992

INVENTOR(S) : Harvey J. Palmer, et al

It is certified that error appears in the above-indentified patent and that said Letters Patent is hereby corrected as shown below:

Column 1, line 52;
Column 3, line 1; and
Column 4, line 52 the equation should read:

--(I) $R_O < (\sigma/\rho g)^{1/2}$--

Column 1, line 65;
Column 3, line 10; and
Column 4, line 64 the equation should read:

--(II) $dz/dr < (\sigma^2/(\rho g^2)^2 - 1)^{1/2}$--

Signed and Sealed this

Twenty-sixth Day of October, 1993

*Attest:*

Bruce Lehman

BRUCE LEHMAN

*Attesting Officer*

*Commissioner of Patents and Trademarks*